US010864574B2

(12) United States Patent
Lehmann et al.

(10) Patent No.: US 10,864,574 B2
(45) Date of Patent: Dec. 15, 2020

(54) CORE-SHELL PARTICLES FOR USE AS A FILLER FOR FEEDER COMPOSITIONS

(71) Applicant: HÜTTENS-ALBERTUS CHEMISCHE WERKE GESELLSCHAFT MIT BESCHRÄNKTER HAFTUNG, Düsseldorf (DE)

(72) Inventors: Sandra Lehmann, Potsdam (DE); Klaus Riemann, Wunstorf (DE); Nils Zimmer, Garbsen (DE); Hermann Lieber, Langenhagen (DE); Jürgen Hübert, Langenhagen (DE)

(73) Assignee: HÜTTENES-ALBERTUS CHEMISCHE WERKE GESELLSCHAFT MIT BESCHRÄNKTER HAFTUNG, Düsseldorf (DE)

( * ) Notice: Subject to any disclaimer, the term of this patent is extended or adjusted under 35 U.S.C. 154(b) by 171 days.

(21) Appl. No.: 16/312,171

(22) PCT Filed: Jun. 27, 2017

(86) PCT No.: PCT/EP2017/065812
§ 371 (c)(1),
(2) Date: Dec. 20, 2018

(87) PCT Pub. No.: WO2018/002027
PCT Pub. Date: Jan. 4, 2018

(65) Prior Publication Data

US 2019/0201970 A1 Jul. 4, 2019

(30) Foreign Application Priority Data

Jun. 30, 2016 (DE) ..... 10 2016 211 948

(51) Int. Cl.
*B22C 9/08* (2006.01)
*B22C 1/00* (2006.01)
(Continued)

(52) U.S. Cl.
CPC ..... *B22C 9/08* (2013.01); *B22C 1/00* (2013.01); *B22C 1/02* (2013.01); *B22C 1/18* (2013.01)

(58) Field of Classification Search
CPC .... B22C 9/08; B22C 1/00; B22C 1/18; B22C 1/02
See application file for complete search history.

(56) References Cited

U.S. PATENT DOCUMENTS 3,456,914 A 7/1969 Konrad et al.
2004/0091709 A1* 5/2004 Ohmura ..... C08J 9/20 428/404
(Continued)

FOREIGN PATENT DOCUMENTS

CN 1032754 5/1989
CN 102199040 9/2011
(Continued)

OTHER PUBLICATIONS

Pilato, "Phenolic Resins: A Century of Progress", Springer-Verlag Berlin Heidelberg, 2010.
(Continued)

*Primary Examiner* — Alexander C Kollias
(74) *Attorney, Agent, or Firm* — Duane Morris, LLP; Gregory M. Lefkowitz

(57) ABSTRACT

The invention relates to core-shell particles for use as a filler for feeder compositions for producing feeders, comprising (a) a core which possesses one or more cavities and a wall surrounding these cavities, where the core (a) has an average diameter in the range from 0.15 to 0.45 mm, (b) a shell
(Continued)

Figure 1:
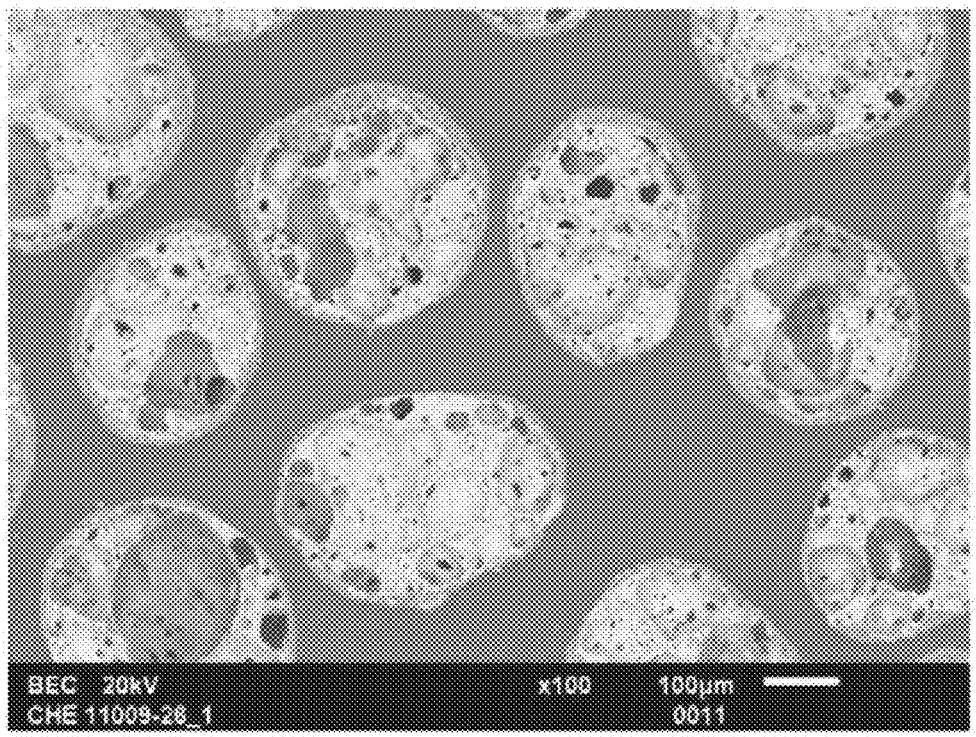

enclosing the core and consisting of or comprising (b1) particles comprising or consisting of a material from the group consisting of calcined kaolin or cordierite, where the particles (b1) have a d10 of at least 0.05 μm and a d90 of at most 45 μm, and also (b2) a binder which binds the particles (b1) to one another and to the core (a).

15 Claims, 4 Drawing Sheets

(51) Int. Cl.
*B22C 1/18* (2006.01)
*B22C 1/02* (2006.01)

(56) References Cited

U.S. PATENT DOCUMENTS

2006/0078682 A1* 4/2006 McDaniel ..... C09K 3/1436
427/372.2
2010/0203121 A1* 8/2010 Toledano ..... B01J 13/14
424/455
2011/0315911 A1* 12/2011 Lanver ..... B22C 9/084
252/62
2013/0062549 A1 3/2013 Angenendt et al.
2016/0376199 A1* 12/2016 Koep ..... C04B 35/64
507/271
2017/0296479 A1* 10/2017 Nagata ..... A61K 9/5089

FOREIGN PATENT DOCUMENTS

| | | |
|---|---|---|
| CN | 103130523 | 6/2013 |
| DE | 102007012660 | 9/2008 |
| DE | 102007051850 | 5/2009 |
| DE | 102010009146 | 8/2011 |
| DE | 102012200967 | 7/2013 |
| EP | 0913215 | 6/1999 |
| EP | 1057554 | 12/2000 |
| EP | 0888199 | 9/2002 |
| EP | 1728571 | 12/2006 |
| WO | 94/23865 | 10/1994 |
| WO | 2006/058347 | 6/2006 |
| WO | 2008/113765 | 9/2008 |
| WO | 2013/150159 | 10/2013 |

OTHER PUBLICATIONS

VDG Merkblatt, "Urethane-Cold-Box Process Handling of Input Materials, Gases and Vapors As Well As Residues", VDG Association of German Foundry People, Feb. 1998, 6 pages.
"Test sieves—Technical requirements and testing—Part 1:L Test sieves of metal wire cloth", DIN ISO 3310-1, Sep. 2001, 17 pages.

* cited by examiner

CORE-SHELL PARTICLES FOR USE AS A FILLER FOR FEEDER COMPOSITIONS

CROSS-REFERENCE TO RELATED APPLICATIONS

This application is a § 371 national stage entry of International Application No. PCT/EP2017/065812, filed on Jun. 27, 2017, which claims priority to German Patent Application No. 102016211948.6, filed on Jun. 30, 2016, the entire contents of which are incorporated herein by reference.

The present invention relates to core-shell particles for use as a filler for feeder compositions for producing feeders, to a corresponding pourable filling material which comprises a multiplicity of core-shell particles of the invention, to methods for producing core-shell particles of the invention or pourable filling materials of the invention, to corresponding feeder compositions and corresponding feeders, and also to corresponding uses. Further subjects of the present invention are apparent from the description below and the appended claims.

The term "feeders" in the context of the present papers encompasses feeder surrounds, feeder sleeves and feeder caps, and also heating pads.

In the production of shaped metallic parts in the foundry industry, liquid metal is introduced into a casting mold, where it solidifies. The solidification process entails a reduction within the metal volume, and therefore, generally, feeders—that is, open or closed spaces in or on the casting mold—are used in order to compensate the volume deficit on solidification of the casting and so to prevent cavities forming in the casting. Feeders are connected to the casting, or to the region of the casting that is at risk, and are commonly located above and/or at the side of the molding cavity.

In feeder compositions for producing feeders, and in the feeders themselves that are produced from these compositions, it is nowadays generally the case that lightweight fillers are used, being intended to produce effective insulation with high temperature stability.

DE 10 2005 025 771 B3 discloses insulating feeders comprising hollow ceramic spheres and hollow glass spheres.

EP 0 888 199 B1 describes feeders which comprise hollow aluminum silicate microspheres as insulating refractory material.

EP 0 913 215 B1 discloses feeder compositions which comprise hollow aluminum silicate microspheres with an aluminum oxide content at less than 38 wt %.

WO 9423865 A1 discloses a feeder composition comprising hollow, aluminum oxide-containing microspheres having an aluminum oxide fraction of at least 40 wt %.

WO 2006/058347 A2 discloses feeder compositions which as fillers comprise core-shell microspheres having a polystyrene core. The use of polystyrene, however, leads to unwanted emissions in foundry operation.

DE 10 2007 012 660 A1 discloses core-shell particles having a carrier core and a shell enclosing the core, the core-shell particles being stable up to a temperature of at least 1450° C. Proposed as shell material are aluminum oxide, boron nitride, silicon carbide, silicon nitride, titanium boride, titanium oxide, yttrium oxide, and zirconium oxide.

US 2006/0078682 A1 describes "proppants" having an organic substrate and an organic shell material, the organic shell material comprising inorganic fillers. Inorganic fillers proposed are oxides, carbides, nitrides, and borides. The field of application for the "proppants" described is that of use in gravel embankments or as fracturing supports. Any use of the described core-shell particles in feeder compositions is not described.

DE 10 2012 200 967 A1 describes the use of calcined kieselguhr as a molding material component in a moldable composition for producing feeders and/or feeder components for the foundry industry in accordance with the polyurethane cold box process. Also described is the use of a mixture of calcined kieselguhr and other molding material components such as, for example, kaolin, sand, silica sand, fireclay sand, and coke chips. The use of calcined kaolin or cordierite is not described.

DE 10 2007 051 850 A1 describes a molding mixture for producing casting molds for metal processing, a method for producing casting molds, casting molds obtained by the method, and the use thereof. The casting molds are produced using a refractory molding base material and also a waterglass-based binder. The refractory molding base material may comprise, for example, mullite, corundum, ß-cristobalite, $TiO_2$ or $FeO_3$. The use of calcined kaolin or cordierite is not described.

WO 2013/150159 A2 describes an exothermic feeder for the foundry industry and use thereof for the dense feeding of castings, and also a moldable composition for producing an exothermic feeder. Fillers described as being suitable include cordierite, andalusite, sillimanite, kyanite (disthene), mullite, nepheline or feldspar. These materials are not, however, disclosed as a constituent for core-shell particles.

In the industrial practice of feeder production, it is nowadays common to use hollow spheres which originate from the fly ashes from coal-fired power stations. These hollow spheres suitable for use in feeders are, however, not available unlimitedly in the grades required. The use of hollow synthetic beads is also possible. Such beads, however, frequently do not have the required properties to achieve effective insulating properties in the completed feeder. It was an object of the present invention, therefore, to specify a lightweight filler which can be used as a substitute for the hollow spheres that are currently favored.

The lightweight filler to be specified ought to meet the following primary requirements:

- thermal stability for the casting of iron (1400° C. and above) and steel (1600° C. and above);
- sufficient mechanical stability even at high temperatures of, for example, 1400° C.;
- little or no dust adherence;
- low bulk density;
- high insulating effect on use of the lightweight filler in feeders.

The stated object is achieved in accordance with the invention by means of core-shell particles for use as a filler for feeder compositions for producing feeders, comprising (a) a core which possesses one or more cavities and a wall surrounding these cavities,
  where the core (a) has an average diameter in the range from 0.15 to 0.45 mm, (b) a shell enclosing the core and consisting of or comprising (b1) particles comprising or consisting of a material from the group consisting of calcined kaolin or cordierite,
  where the particles (b1) have a d10 of at least 0.05 μm and a d90 of at most 45 μm, and also (b2) a binder which binds the particles (b1) to one another and to the core (a).

In our own investigations it has surprisingly emerged that the combination of a core which possesses one or more cavities and a wall surrounding these cavities with a shell which comprises particles of calcined kaolin or cordierite (preferably calcined kaolin) combines very good thermal and mechanical stability with excellent insulating effect which core-shell particles hitherto known have not been able to achieve.

In one embodiment of the invention, it is preferred if the core (a) has a d50 in the range from 0.15 mm to 0.25 mm. It is further preferred if the core (a) has a d10 in the range from 0.05 mm to 0.15 mm and a d90 in the range from 0.25 to 0.35 mm and/or has an average particle size d50 of 0.15 mm to 0.25 mm, preferably an average particle size d50 of 0.17 mm to 0.22 mm, more preferably an average particle size d50 of 0.19 mm to 0.21 mm.

In an alternative embodiment of the invention, it is preferred if the core (a) has a d50 in the range from 0.3 mm to 0.48 mm. It is further preferred if the core (a) has a d10 in the range from 0.2 mm to 0.3 mm and a d90 in the range from 0.4 mm to 0.6 mm and/or has an average particle size d50 of 0.30 mm to 0.48 mm, preferably an average particle size d50 of 0.33 mm to 0.45 mm, more preferably an average particle size d50 of 0.37 mm to 0.43 mm.

It is preferred in accordance with the invention if the particles (b1)

i) have a d10 of greater than or equal to 0.07 μm, preferably a d10 of 0.1 μm, more preferably a d10 of 0.15 μm and/or ii) have a d90 of less than or equal to 40 μm, preferably a d90 of less than or equal to 20 μm, more preferably a d90 of less than or equal to 10 μm.

It is especially preferred if the particles (b1) have a d10 of greater than or equal to 0.07 μm and a d90 of less than or equal to 40 μm, preferably a d10 of greater than or equal to 0.1 μm and a d90 of less than or equal to 20 μm, more preferably a d10 of greater than or equal to 0.15 μm and a d90 of less than or equal to 10 μm.

It is likewise preferred in accordance with the invention if the particles (b1) have a d50 in the range from 0.5 to 12 μm, preferably a d50 in the range from 1 to 8 μm, more preferably in the range from 1 to 5 μm.

In our own investigations it has emerged that the cores (a) and the particles (b1) with the sizes specified above have particularly good properties for use in feeder compositions or in pourable filling materials for feeder compositions.

In an alternative embodiment of the core-shell particles of the invention, the core (a) has a bimodal or multimodal size distribution, preferably with a first diameter maximum in the range from 0.1 mm to 0.3 mm and a second diameter maximum in the range from 0.25 mm to 0.5 mm. Bimodal size distributions are preferred in accordance with the invention.

Through the use of core-shell particles having a bimodal or multimodal size distribution it is possible to achieve a greater packing density of the core-shell particles. In our own investigations it has emerged that this improves the strength of the feeders when the core-shell particles are used as a filler for feeders.

Preferred in accordance with the invention are core-shell particles where the core (a) comprises glass or consists of glass, more particularly expanded glass or foamed glass.

Our own investigations have shown, surprisingly, that core-shell particles having cores which comprise glass or consist of glass (more particularly of expanded glass or foamed glass) have very good insulating properties when used as a filler for feeder compositions for producing feeders. Particularly in the context of their use for producing feeders for the casting of iron or steel, the skilled person would not have used particles comprising glass or consisting of glass, because they melt at the temperatures required for casting.

Likewise preferred are core-shell particles of the invention where the core (a) comprises silicon dioxide and aluminum oxide, with the weight ratio between silicon dioxide and aluminum oxide being preferably 27:1 or more, preferably 30:1 or more, more preferably 45:1 or more, in the particles (b1) the weight ratio between silicon dioxide and aluminum oxide is in the range from 1:1 to 1:1.6.

In one embodiment of the invention it is preferred if the core-shell particles have a d10 in the range from 0.1 mm to 0.2 mm and a d90 in the range from 0.30 mm to 0.40 mm. It is especially preferred if the core-shell particles have an average particle size d50 of 0.2 mm to 0.3 mm, preferably an average particle size d50 of 0.22 mm to 0.27 mm, more preferably an average particle size d50 of 0.24 mm to 0.26 mm.

In an alternative embodiment of the invention it is preferred if the core-shell particles have a d10 in the range from 0.30 mm to 0.40 mm and a d90 in the range from 0.50 mm to 0.60 mm. It is especially preferred if the core-shell particles have an average particle size d50 of 0.4 mm to 0.5 mm, preferably an average particle size d50 of 0.42 mm to 0.47 mm, more preferably an average particle size d50 of 0.44 mm to 0.46 mm.

In an alternative embodiment of the core-shell particles of the invention, the core-shell particles have a bimodal or multimodal size distribution, preferably having a first diameter maximum in the range from 0.15 mm to 0.35 mm and a second diameter maximum in the range from 0.35 mm to 0.55 mm. Bimodal size distributions are preferred in accordance with the invention. Core-shell particles having a bimodal size distribution of the particles can be obtained, for example, by mixing together the above-described core-shell particles having two different sizes.

In one preferred embodiment of the invention, it is preferable if bimodal core-shell particles are obtained by mixing (I) core-shell particles having a d10 in the range from 0.1 mm to 0.2 mm and a d90 in the range from 0.30 mm to 0.40 mm, it being especially preferred if the core-shell particles have an average particle size d50 of 0.2 mm to 0.3 mm, preferably an average particle size d50 of 0.22 mm to 0.27 mm, more preferably an average particle size d50 of 0.24 mm to 0.26 mm with (II) core-shell particles having a d10 in the range from 0.30 mm to 0.40 mm and a d90 in the range from 0.50 mm to 0.60 mm, it being especially preferred if the core-shell particles have an average particle size d50 of 0.4 mm to 0.5 mm, preferably an average particle size d50 of 0.42 mm to 0.47 mm, more preferably an average particle size d50 of 0.44 mm to 0.46 mm.

The particle size (e.g. d10, d50, and d90) of the cores and of the core-shell particles is determined in accordance with DIN 66165-2, F and DIN ISO 3310-1.

The particle size of the particles (b1) is determined by means of laser diffraction.

The binder (b2) is preferably an organic or inorganic binder or a mixture of organic or inorganic binder, and the binder is preferably selected from the group consisting of polymer-based binders, waterglass-based binders, phenol-formaldehyde resins, polyurethane binder curable by the cold box process, polyurethane binder with tetraethylsilicate (TEOS) and/or vegetable oil esters (preferably methyl and butyl esters) as solvent, two-component systems comprising a polyol component (preferably a phenolic resin) containing free hydroxyl groups (OH groups) and a polyisocyanate as co-reactant, polysaccharides, and starch.

In the case of the above-described two-component systems, free hydroxyl groups means that the hydroxyl groups are not etherified. Preferred phenolic resins which can be used as a polyol component are ortho-condensed phenolic resoles (also referred to as benzyl ether resins) as described in EP 1 057 554 B1, for example. In accordance with the customary understanding of the skilled person, the term "ortho-condensed phenolic resol" or benzyl ether resin also embraces compounds with the structure according to the text book "Phenolic Resins: A Century of progress" (Editor: L. Pilato, Publisher: Springer, Year of publication: 2010) page 477, figure 18.22, and compounds which according to the VDG [German Automakers Association] R 305 datasheet on "Urethane Cold Box Process" (February 1998) are identified as "Benzyl ether resin (Ortho Phenol Resol)" and/or are covered by the formula for benzyl ether polyols that is specified in paragraph 2.2.

Among the two-component systems comprising a polyol component (preferably a phenolic resin) containing free hydroxyl groups (OH groups) and a polyisocyanate as co-reactant, cold box binders are preferred. cold box binders are binders which are cured by tertiary amine catalysts supplied in mist or vapor form ("gassing").

Preferred in accordance with the invention are organic binders, preferably cold box binders, where the cold box binder is cured by gassing with an organic amine.

A further aspect of the present invention relates to a pourable filling material for use as a filler for feeder compositions for producing feeders, comprising or consisting of a multiplicity of core-shell particles of the invention.

Preference is given to a pourable filling material of the invention that comprises or consists of a mixture of core-shell particles of the invention and particles consisting of or comprising cordierite, where the particles consisting of or comprising cordierite are not the particles (b1) of the core-shell particles. The particles consisting of or comprising cordierite preferably have a d10 of more than 0.045 mm. The particles consisting of or comprising cordierite are particles which in the pourable filling material are not bound by means of a binder to the core-shell particles of the invention or to the cores (a) of the core-shell particles.

Our own investigations have shown that feeders have particularly good insulating properties and hence a positive effect on formation of cavities, and possess very good temperature stability, when the pourable filling material of the invention comprises mixtures of core-shell particles of the invention with particles consisting of or comprising cordierite.

Preference here is given to a pourable filling material of the invention wherein the fraction of particles consisting of or comprising cordierite is 10 to 60%, preferably 20 to 50%, more preferably 25 to 40%, based on the total weight of core-shell particles of the invention and particles consisting of or comprising cordierite.

It has emerged that pourable filling materials of the invention with these fractions of particles consisting of or comprising cordierite have particularly good properties.

Preference is given to a pourable filling material of the invention wherein the particles consisting of or comprising cordierite have an average particle size in the range from 0.1 to 0.4 mm, determined by means of DIN 66165-2, F and DIN ISO 3310-1.

In one preferred embodiment, the particles consisting of or comprising cordierite have a) a d10 of greater than or equal to 0.05 mm and a d90 of less than or equal to 0.60 mm and/or b) a d50 of 0.13 mm to 0.4 mm, preferably 0.18 mm to 0.32 mm.

A pourable filling material of the invention having a bulk density of less than 0.8 g/cm$^3$ is preferred, preferably with a bulk density of less than 0.7 g/cm$^3$, more preferably with a bulk density of less than 0.6 g/cm$^3$.

A further aspect of the present invention relates to a method for producing core-shell particles of the invention or of a pourable filling material of the invention, having the following steps:

providing cores (a) which each possess one or more cavities and a wall surrounding these cavities, where the cores (a) have a d50 in the range from 0.15 to 0.45 mm, providing particles (b1) comprising or consisting of a material from the group consisting of calcined kaolin or cordierite, where the particles (b1) have a d10 of at least 0.05 μm and a d90 of at most 45 μm, contacting the cores (a) with the particles (b1) in the presence of a binder (b2), so that particles (b1) are bound to cores (a) and to one another, and individual or all the cores (a) are enveloped, curing and/or drying the binder.

In one preferred embodiment of the method of the invention, first the cores (a) are wetted with the binder (b2) and then the particles (b2) are added to the cores (a) wetted with the binder (b2), so that particles (b1) are bound to cores (a) and to one another and envelop individual or all of the cores (a).

Likewise preferred is a method for producing a pourable filling material of the invention, further comprising the following step:

mixing the core-shell particles produced with particles consisting of or comprising cordierite, where the particles consisting of or comprising cordierite are not the particles (b1) of the core-shell particles.

A further aspect in connection with the present invention relates to a moldable composition for producing feeders, consisting of or comprising:

core-shell particles of the invention or a pourable filling material of the invention and also a binder for binding the core-shell particles or the pourable filling material.

Preferred in accordance with the invention is a moldable composition, where the binder is an organic or inorganic binder or a mixture or organic or inorganic binder, and the binder is preferably selected from the group consisting of polymer-based binders, waterglass-based binders, phenol-formaldehyde resins, polyurethane binder curable by the cold box process, polyurethane binder with tetraethylsilicate (TEOS) and/or vegetable oil esters (preferably methyl and butyl esters) as solvent, two-component systems comprising a polyol component (preferably a phenolic resin) containing free hydroxyl groups (OH groups) and a polyisocyanate as co-reactant, polysaccharides, and starch.

According to one preferred embodiment of the present invention, the moldable composition of the invention has a binder fraction of 5 to 25%, preferably 7 to 20%, more preferably 9 to 17%, based on the total weight of core-shell particles of the invention and cordierite in the moldable composition.

A further aspect in connection with the present invention relates to a feeder comprising core-shell particles of the invention bound by a cured and/or dried binder.

The binder is preferably an organic or inorganic binder or a mixture or organic or inorganic binder, and the binder is preferably selected from the group consisting of polymer-based binders, waterglass-based binders, phenol-formaldehyde resins, polyurethane binder curable by the cold box process, polyurethane binder with tetraethylsilicate (TEOS) and/or vegetable oil esters (preferably methyl and butyl esters) as solvent, two-component systems comprising a polyol component (preferably a phenolic resin) containing free hydroxyl groups (OH groups) and a polyisocyanate as co-reactant, polysaccharides, and starch.

Preferred in accordance with the invention are feeders comprising a mixture of core-shell particles of the invention and particles consisting of or comprising cordierite, bound by a cured and/or dried binder.

Particularly preferred are feeders of the invention where the fraction of the particles consisting of or comprising cordierite is 10 to 60%, preferably 20 to 50%, more preferably 25 to 40%, based on the total weight of core-shell particles of the invention and particles consisting of or comprising cordierite.

Likewise preferred in accordance with the invention are feeders having a density of less than 1.0 g/cm$^3$, preferably of less than 0.8 g/cm$^3$, more preferably of less than 0.7 g/cm$^3$.

A particularly preferred feeder in the context of the present invention is an insulating feeder.

In one preferred embodiment of the present invention, in which the feeder is an insulating feeder, the maximum fraction of readily oxidizable metals and oxidizing agent is at most 5 wt %, preferably at most 2.5 wt % based on the total weight of the feeder of the invention. With very particular preference an insulating feeder of the invention contains no readily oxidizable metals and oxidizing agent. Readily oxidizable metals are understood in the context of this invention to be aluminum, magnesium or silicon, or corresponding metal alloys. Oxidizing agents are understood as agents which are able to oxidize the readily oxidizable metals, with the exception of oxygen.

A particularly preferred feeder in the context of the present invention is a feeder for the casting of steel and/or for the casting of iron.

A further aspect in connection with the present invention relates to a use of core-shell particles of the invention or of a pourable filling material of the invention as insulating filling material for producing a feeder or a moldable composition for producing a feeder.

A further aspect of the present invention relates to a use of a feeder of the invention for the casting of iron or casting of steel.

In the context of the present invention, it is preferred for two or more of the aspects identified above as being preferred to be actualized at one and the same time; especially preferred are the combinations of such aspects and of the corresponding features that arise from the appended claims.

FIG. 1 shows a scanning electron micrograph of a polished section of core-shell particles of the invention having a core of expanded glass and a shell of calcined kaolin.

Figure 2:
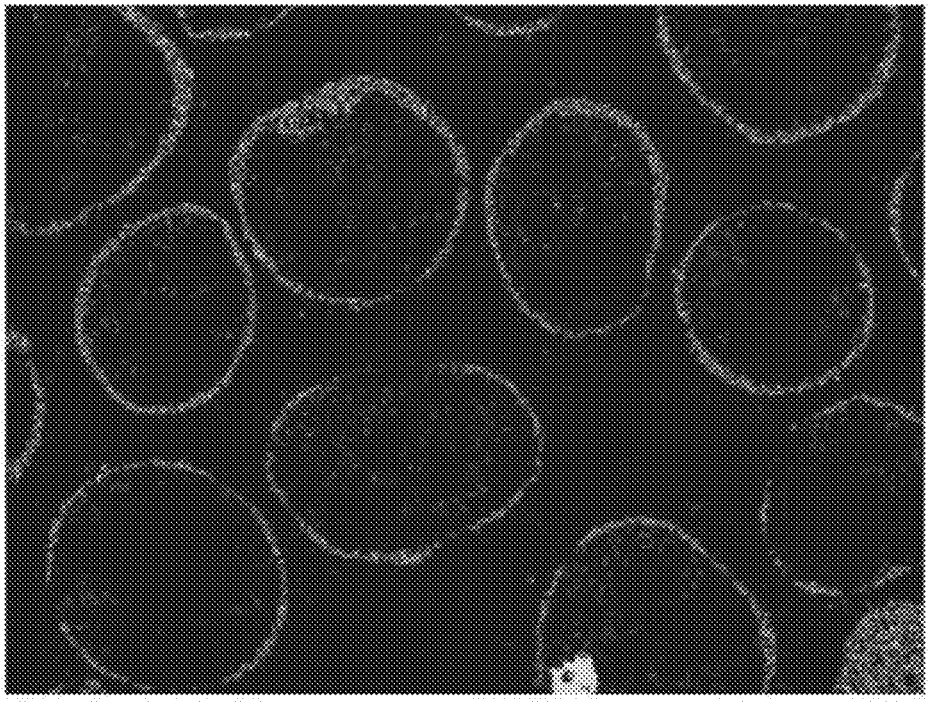

FIG. 2 depicts an aluminum element mapping image of the scanning electron micrograph from FIG. 1. The regions shown as light contain aluminum. It is clearly apparent here that the aluminum-containing shell particles (b1) are arranged around the core (a).

Figure 3:
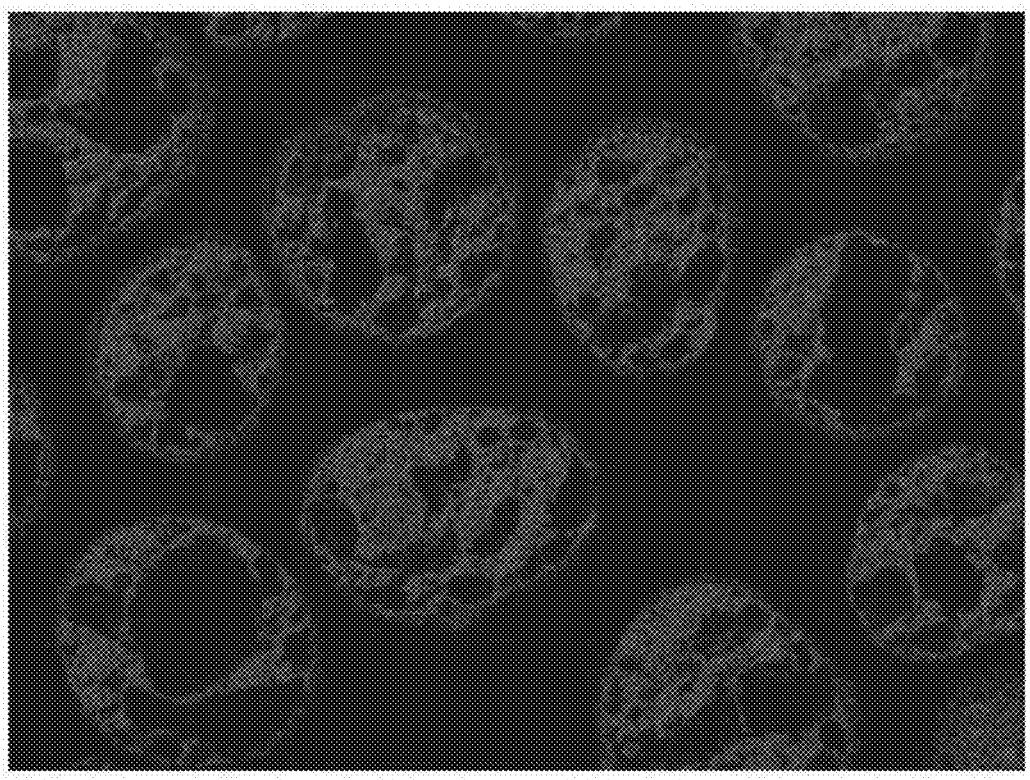

FIG. 3 shows a silicon element mapping image of the scanning electron micrograph from FIG. 1. The regions shown as light contain silicon. It is clearly apparent here that both the core particles of expanded glass ($SiO_2$) and the shell particles contain silicon.

Figure 4:
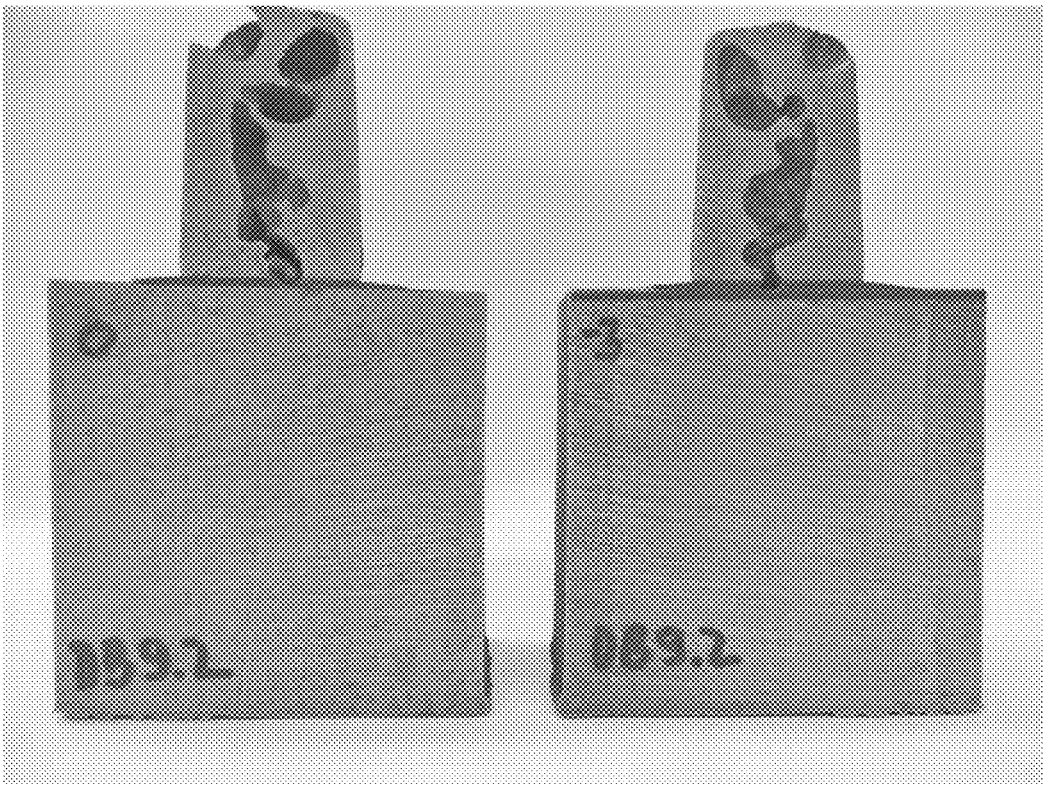

FIG. 4 shows the photograph of a cut-open cube casting with residual feeder for the cube tests described in more detail in the examples. The casting was made using a feeder produced according to working example 9. The lowest point of the cavity is located 3 mm in the casting. This gives a cavity depth of −3 mm.

Figure 5:
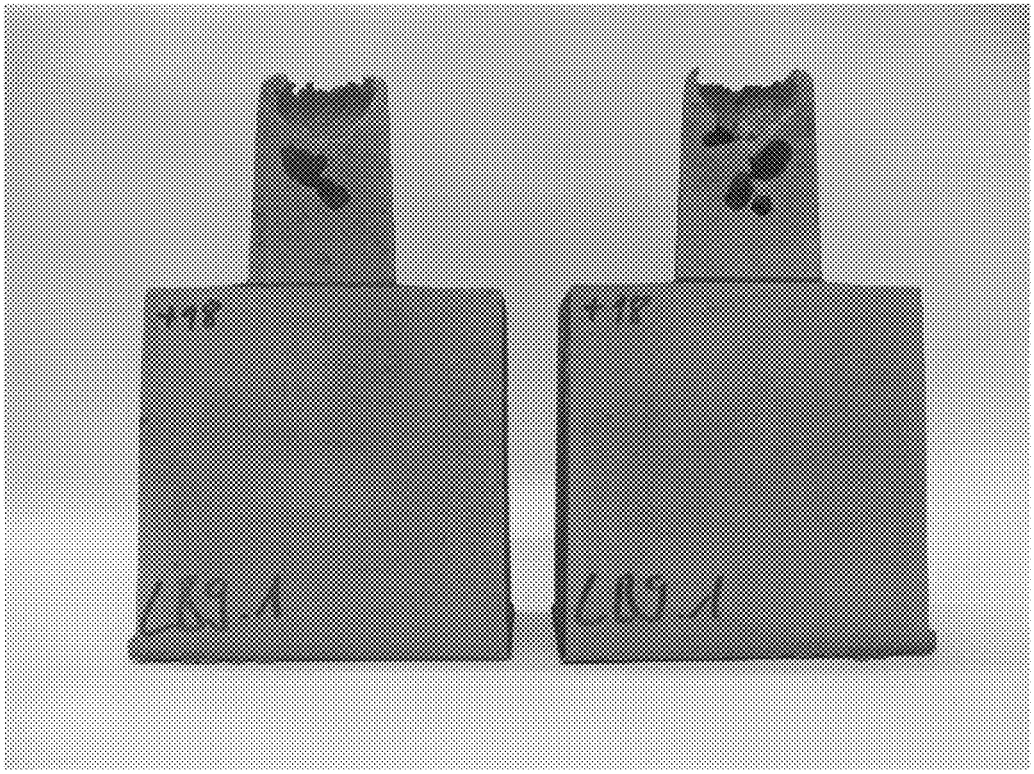

FIG. 5 shows the photograph of a cut-open cube casting with residual feeder for the cube tests described in more detail in the examples. The casting was made using a feeder produced according to working example 10. The lowest point of the cavity is located 18 mm above the casting in the residual feeder. This gives a cavity depth of +18 mm.

Figure 6:
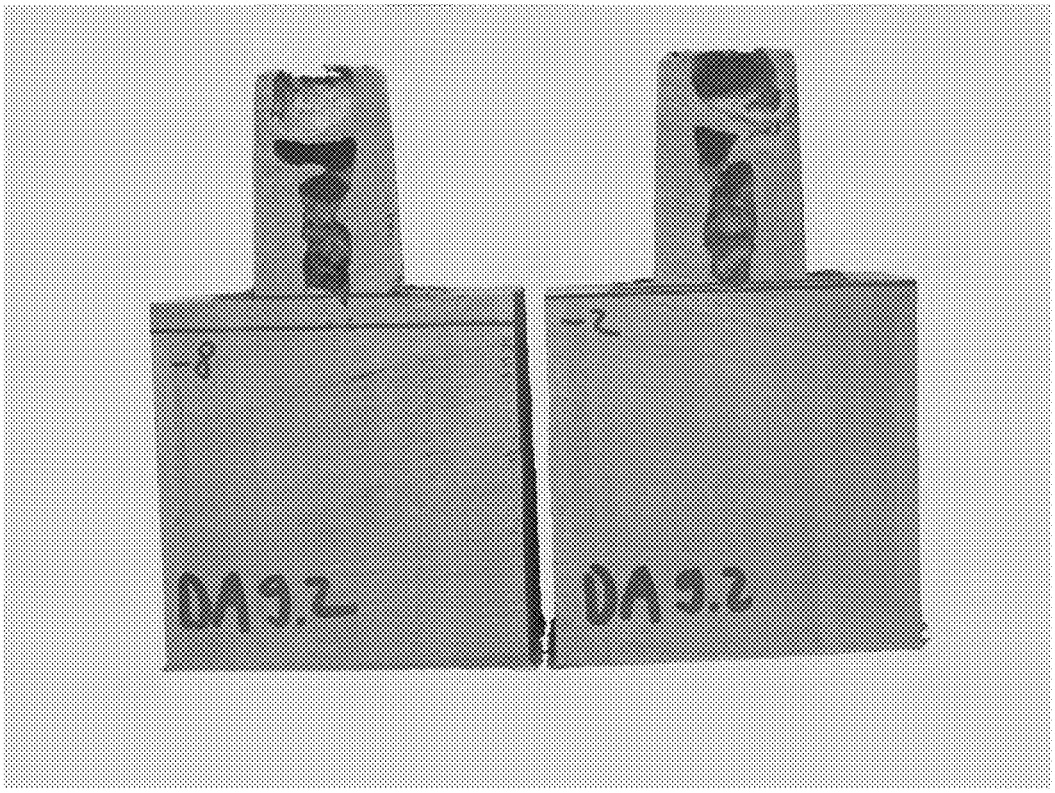

FIG. 6 shows the photograph of a cut-open cube casting with residual feeder for the cube tests described in more detail in the examples. The casting was made using a feeder produced according to comparative example 3. The lowest point of the cavity is located 8 mm in the casting. This gives a cavity depth of −8 mm.

Figure 7:
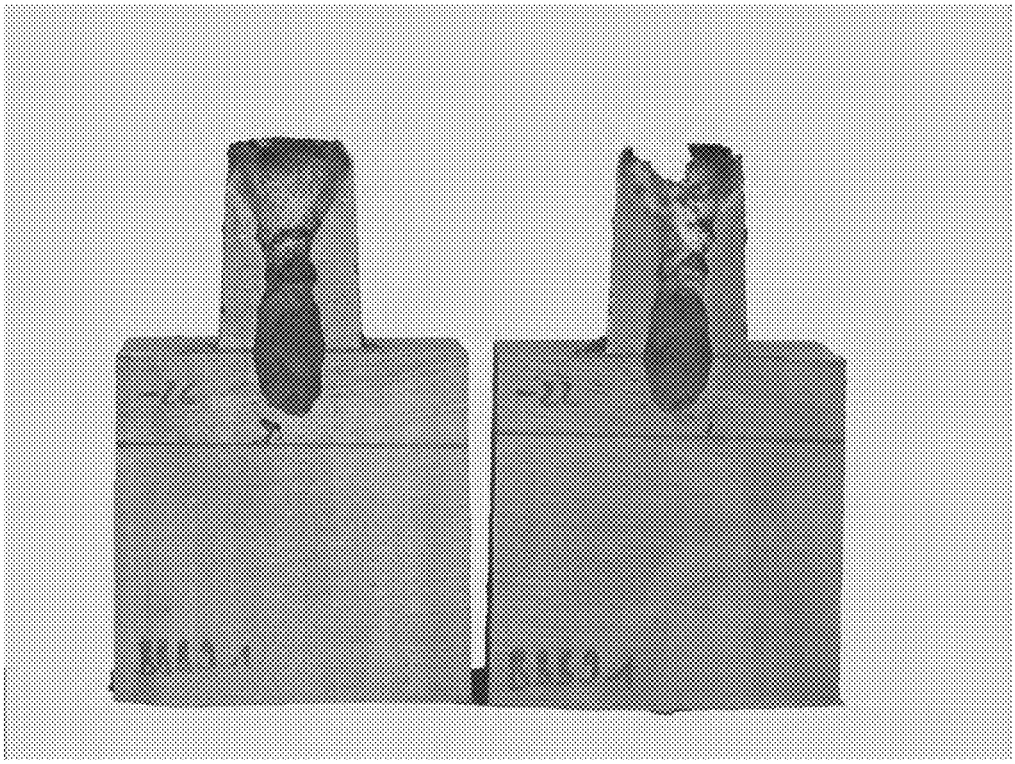

FIG. 7 shows the photograph of a cut-open cube casting with residual feeder for the cube tests described in more detail in the examples. The casting was made using a feeder produced according to comparative example 4. The lowest point of the cavity is located 26 mm in the casting. This gives a cavity depth of −26 mm.

Figure 8:
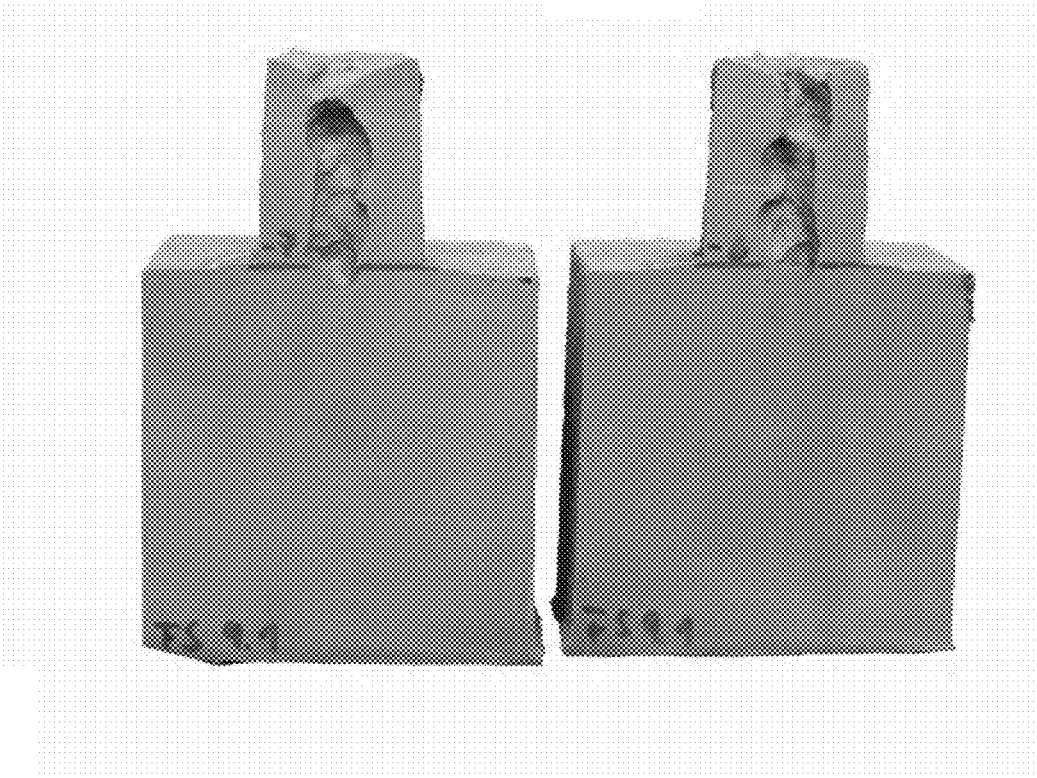

FIG. 8 shows the photograph of a cut-open cube casting with residual feeder for the cube tests described in more detail in the examples. The casting was made using a feeder produced according to comparative example 5. The lowest point of the cavity is located 7 mm in the casting. This gives a cavity depth of −7 mm.

The invention is elucidated in more detail below using examples and figures:

A Production of Inventive Core-Shell Particles (Bulk Product):

WORKING EXAMPLE 1

A BOSCH Profi 67 mixer is charged with 664 g of Liaver expanded glass (standard particle size 0.1 to 0.3 mm; Liaver GmbH und Co. KG) as carrier material and this initial charge is wetted uniformly with 72 g of cold box binder (from Hüttenes-Albertus: Benzyl ether resin based on Activator 6324/Gas resin 7241 with an Activator 6324: Gas resin 7241 ratio of 1:1). 136 g of calcined kaolin (d50=1.4 μm, d10=0.4 μm, d90=7 μm) are added and the components are mixed homogeneously. Lastly around 0.5 mL of dimethyl propyl amine is added to cure the binder. After a few seconds, the core-shell particles formed are in the form of a bulk product for further use.

WORKING EXAMPLE 2

A BOSCH Profi 67 mixer is charged with 640 g of Liaver expanded glass (standard particle size 0.25 to 0.5 mm; Liaver GmbH und Co. KG) as carrier material and this initial charge is wetted uniformly with 72 g of cold box binder (from Hüttenes-Albertus: Benzyl ether resin based on Activator 6324/Gas resin 7241 with an Activator 6324: Gas resin 7241 ratio of 1:1). 160 g of calcined kaolin (d50=1.4 μm, d10=0.4 μm, d90=7 μm) are added and the components are mixed homogeneously. Lastly around 0.5 mL of dimethyl propyl amine is added to cure the binder. After a few seconds, the core-shell particles formed are in the form of a bulk product for further use.

WORKING EXAMPLE 3

A BOSCH Profi 67 mixer is charged with 664 g of Poraver foamed glass (standard particle size 0.1-0.3; Dennert Poraver GmbH) as carrier material and this initial charge is wetted uniformly with 72 g of cold box binder (from Hüttenes-Albertus: Benzyl ether resin based on Activator 6324/Gas resin 7241 with an Activator 6324: Gas resin 7241 ratio of 1:1). 136 g of calcined kaolin (d50=1.4 μm, d10=0.4 μm, d90=7 μm) are added and the components are mixed homogeneously. Lastly around 0.5 mL of dimethyl propyl amine is added to cure the binder. After a few seconds, the core-shell particles formed are in the form of a bulk product for further use.

WORKING EXAMPLE 4

A BOSCH Profi 67 mixer is charged with 640 g of Poraver foamed glass (standard particle size 0.25-0.5; Dennert Poraver GmbH) as carrier material and this initial charge is wetted uniformly with 72 g of cold box binder (from Hüttenes-Albertus: Benzyl ether resin based on Activator 6324/Gas resin 7241 with an Activator 6324: Gas resin 7241 ratio of 1:1). 160 g of calcined kaolin (d50=1.4 μm, d10=0.4 μm, d90=7 μm) are added and the components are mixed homogeneously. Lastly around 0.5 mL of dimethyl propyl amine is added to cure the binder. After a few seconds, the core-shell particles formed are in the form of a bulk product for further use.

B Production of Comparative Core-Shell Particles (Not Inventive):

COMPARATIVE EXAMPLE 1 (NOT INVENTIVE)

A BOSCH Profi 67 mixer is charged with 700 g of Poraver (standard particle size 0.1-0.3; Dennert Poraver GmbH) as carrier material and this initial charge is wetted uniformly with 120 g of cold box binder (from Hüttenes-Albertus: Benzyl ether resin based on Activator 6324/Gas resin 7241 with an Activator 6324: Gas resin 7241 ratio of 1:1). 300 g of silicon carbide powder (d50 for particle size: <5 μm) are added and the components are mixed homogeneously. Lastly around 0.5 mL of dimethyl propyl amine is added to cure the binder. After a few seconds, the core-shell particles formed are in the form of a bulk product for further use.

COMPARATIVE EXAMPLE 2 (NOT INVENTIVE)

For the carrier core, a suitable BOSCH Profi 67 mixer is charged with 560 g of Poraver (standard particle size 0.1-0.3; Dennert Poraver GmbH) as carrier material and this initial charge is wetted uniformly with 72 g of cold box binder (from Hüttenes-Albertus: Benzyl ether resin based on Activator 6324/Gas resin 7241 with an Activator 6324: Gas resin 7241 ratio of 1:1). 240 g of aluminum oxide powder (d50 for particle size: around 12 μm) are added and the components are mixed homogeneously. Lastly around 0.5 mL of dimethyl propyl amine is added to cure the binder. After a few seconds, the core-shell particles formed are in the form of a bulk product for further use.

C Production of Feeder Compositions and also Feeder Caps and other Profile Elements:

WORKING EXAMPLE 5

The core-shell particles produced according to working example 1 are mixed homogeneously with cold box binder (from Hüttenes-Albertus: Benzyl ether resin based on Activator 6324/Gas resin 7241 with an Activator 6324: Gas resin 7241 ratio of 1:1). From the resulting mixture, feeder caps and other profile moldings (a) are rammed and (b) are shot using core shooting machines (e.g., Röper, Laempe). Curing takes place in each case by gassing with dimethylpropylamine.

WORKING EXAMPLE 6

The core-shell particles produced according to working example 2 are mixed homogeneously with cold box binder (from Hüttenes-Albertus: Benzyl ether resin based on Activator 6324/Gas resin 7241 with an Activator 6324: Gas resin 7241 ratio of 1:1). From the resulting mixture, feeder caps and other profile moldings (a) are rammed and (b) are shot using core shooting machines (e.g., Röper, Laempe). Curing takes place in is each case by gassing with dimethylpropylamine.

WORKING EXAMPLE 7

The core-shell particles produced according to working example 3 are mixed homogeneously with cold box binder (from Hüttenes-Albertus: Benzyl ether resin based on Activator 6324/Gas resin 7241 with an Activator 6324: Gas resin 7241 ratio of 1:1). From the resulting mixture, feeder caps and other profile moldings (a) are rammed and (b) are shot using core shooting machines (e.g., Röper, Laempe). Curing takes place in each case by gassing with dimethylpropylamine.

WORKING EXAMPLE 8

The core-shell particles produced according to working example 4 are mixed homogeneously with cold box binder (from Hüttenes-Albertus: Benzyl ether resin based on Activator 6324/Gas resin 7241 with an Activator 6324: Gas resin 7241 ratio of 1:1). From the resulting mixture, feeder caps and other profile moldings (a) are rammed and (b) are shot using core shooting machines (e.g., Röper, Laempe). Curing takes place in each case by gassing with dimethylpropylamine.

WORKING EXAMPLE 9

The core-shell particles produced according to working examples 1 and 2 are mixed homogeneously in a weight ratio of 4:3. The resulting mixture is mixed homogeneously with cold box binder (from Hüttenes-Albertus: Benzyl ether resin based on Activator 6324/Gas resin 7241 with an Activator 6324: Gas resin 7241 ratio of 1:1). From the resulting mixture, feeder caps and other profile moldings (a) are rammed and (b) are shot using core shooting machines (e.g., Röper, Laempe). Curing takes place in each case by gassing with dimethylpropylamine.

WORKING EXAMPLE 10

The core-shell particles produced according to working examples 1 and 2 are mixed homogeneously mixed homogeneously in a weight ratio of 4:3. The resulting mixture is mixed homogeneously with particles consisting of cordierite (standard particle size<5 mm; Cěské lupkové závody, a.s.), resulting in a weight ratio of core-shell particles to cordierite particles of 7:3. This mixture is mixed homogeneously with cold box binder is (from Hüttenes-Albertus: Benzyl ether resin based on Activator 6324/Gas resin 7241 with an Activator 6324: Gas resin 7241 ratio of 1:1). From the resulting mixture, feeder caps and other profile moldings (a) are rammed and (b) are shot using core shooting machines (e.g., Röper, Laempe). Curing takes place in each case by gassing with dimethylpropylamine.

COMPARATIVE EXAMPLE 3 (NOT INVENTIVE)

The core-shell particles produced according to comparative example 1 are mixed homogeneously with cold box binder (from Hüttenes-Albertus: Benzyl ether resin based on Activator 6324/Gas resin 7241 with an Activator 6324: Gas resin 7241 ratio of 1:1). From the resulting mixture, feeder caps and other profile moldings (a) are rammed and (b) are shot using core shooting machines (e.g., Röper, Laempe). Curing takes place in each case by gassing with dimethylpropylamine.

COMPARATIVE EXAMPLE 4 (NOT INVENTIVE)

The core-shell particles produced according to comparative example 2 are mixed homogeneously with cold box binder (from Hüttenes-Albertus: Benzyl ether resin based on Activator 6324/Gas resin 7241 with an Activator 6324: Gas resin 7241 ratio of 1:1).

From the resulting mixture, feeder caps and other profile moldings (a) are rammed and (b) are shot using core shooting machines (e.g., Röper, Laempe). Curing takes place in each case by gassing with dimethylpropylamine.

COMPARATIVE EXAMPLE 5 (NOT INVENTIVE)

445 g of the core-shell particles produced according to comparative example 2 are mixed homogeneously with 250 g of aluminum (spray-atomized Al with a particle grading of <0.2 mm), 60 g of iron oxide, 220 g of potassium nitrate (flowable, commercial product; particle grading less than 2 mm), and 25 g of ignitor, and also cold box binder (from Hüttenes-Albertus: Benzyl ether resin based on Activator 6324/Gas resin 7241 with an Activator 6324: Gas resin 7241 ratio of 1:1). From the resulting mixture, feeder caps and other profile moldings (a) are rammed and (b) are shot using core shooting machines (e.g., Röper, Laempe). Curing takes place in each case by gassing with dimethylpropylamine.

D Cube Tests:

Feeder caps in accordance with the working examples and comparative examples from section C were checked for practical usefulness by means of so-called cube tests. In these tests, a casting in the form of a cube needs to be free from cavities when using a modularly appropriate feeder cap.

Relatively reliable dense feeding was demonstrated for all the embodiments. In the respective residual feeders (above the cubes), the cavity behavior found was better in each case for the working examples than for the comparative examples. The cavity depths determined are reproduced in the table below. Where the cavity depth is negative, this means that the cavity is located at least partly in the casting, whereas a positive value to the cavity depth means that the cavity is formed in the respective residual feeder. The corresponding cube castings with residual feeders are depicted in FIGS. 4 to 8.

| | Working example 9 | Working example 10 | Comparative example 3 | Comparative example 4 | Comparative example 5 |
|---|---|---|---|---|---|
| Cavity depth determined [mm] | −3 | +18 | −8 | −26 | −7 |

The invention claimed is:

1. Core-shell particles for use as a filler for feeder compositions for producing feeders, comprising:

(a) a core possessing one or more cavities and a wall surrounding the one or more cavities, where the core (a) has an average diameter in the range from 0.15 to 0.45 mm;

(b) a shell enclosing the core and consisting of or comprising:

(b1) particles comprising or consisting of a material selected from the group consisting of calcined kaolin and cordierite, where the particles (b1) have a d10 of at least 0.05 μm and a d90 of at most 45 μm; and (b2) a binder which binds the particles (b1) to one another and to the core (a).

2. The core-shell particles as claimed in claim 1, where the core (a) comprises glass or consists of glass.

3. The core-shell particles as claimed in claim 1, where the core (a) comprises silicon dioxide and aluminum oxide, the weight ratio between the silicon dioxide and the aluminum oxide being 27:1 or more, in the particles (b1) the weight ratio between the silicon dioxide and the aluminum oxide is in the range from 1:1 to 1:1.6.

4. The core-shell particles as claimed in claim 1, where (i) the core-shell particles have a d10 in the range from 0.1 mm to 0.2 mm and a d90 in the range from at most 0.30 mm to 0.40 mm, where the core-shell particles have an average particle size d50 of 0.2 mm to 0.3 mm or (ii) the core-shell particles have a d10 in the range from 0.30 mm to 0.40 mm and a d90 in the range from 0.50 mm to 0.60 mm, where the core-shell particles have an average particle size d50 of 0.4 mm to 0.5 mm.

5. The core-shell particles as claimed in claim 1, where the core (a) comprises silicon dioxide and aluminum oxide, the weight ratio between the silicon dioxide and the aluminum oxide being 30:1 or more, in the particles (b1) the weight ratio between the silicon dioxide and the aluminum oxide is in the range from 1:1 to 1:1.6.

6. The core-shell particles as claimed in claim 1, where the core (a) comprises silicon dioxide and aluminum oxide, the weight ratio between the silicon dioxide and the aluminum oxide being 45:1 or more, in the particles (b1) the weight ratio between the silicon dioxide and the aluminum oxide is in the range from 1:1 to 1:1.6.

7. The core-shell particles as claimed in claim 1, where (i) the core-shell particles have a d10 in the range from 0.1 mm to 0.2 mm and a d90 in the range from at most 0.30 mm to 0.40 mm, where the core-shell particles have an average particle size d50 of 0.22 mm to 0.27 mm or (ii) the core-shell particles have a d10 in the range from 0.30 mm to 0.40 mm and a d90 in the range from 0.50 mm to 0.60 mm, where the core-shell particles have an average particle size d50 of 0.42 mm to 0.47 mm.

8. The core-shell particles as claimed in claim 1, where (i) the core-shell particles have a d10 in the range from 0.1 mm to 0.2 mm and a d90 in the range from at most 0.30 mm to 0.40 mm, where the core-shell particles have an average particle size d50 of 0.24 mm to 0.26 mm or (ii) the core-shell particles have a d10 in the range from 0.30 mm to 0.40 mm and a d90 in the range from 0.50 mm to 0.60 mm, where the core-shell particles have an average particle size d50 of 0.44 mm to 0.46 mm.

9. The core-shell particles as claimed in claim 1, where the core (a) consists of or comprises expanded glass or foamed glass.

10. A method for producing core-shell particles as claimed claim 1, comprising:

providing cores (a) which each possess one or more cavities and a wall surrounding the one or more cavities, where the cores (a) have a d50 in the range from 0.15 to 0.45 mm, providing particles (b1) comprising or consisting of a material selected from the group consisting of calcined kaolin and cordierite, where the particles (b1) have a d10 of at least 0.05 μm and a d90 of at most 45 μm;

contacting the cores (a) with the particles (b1) in the presence of a binder (b2), so that particles (b1) are bound to the cores (a) and to one another, and individual or all the cores (a) are enveloped; and curing and/or drying the binder.

11. A method of producing a feeder or a moldable composition for producing a feeder, comprising providing the core-shell particles as claimed in claim 1 as an insulating filling material for the feeder.

12. A pourable filling material for use as a filler for feeder compositions for producing feeders, comprising or consisting of a multiplicity of core-shell particles as claimed in claim 1.

13. A moldable composition for producing feeders, consisting of or comprising:

core-shell particles as claimed in claim 1; and a binder for binding the core-shell particles.

14. A feeder comprising core-shell particles as claimed in claim 1, bound by a binder.

15. A method of casting iron or steel comprising utilizing a feeder as claimed in claim 14.

* * * * *